US005197738A

United States Patent [19]

Hartman, Sr.

[11] Patent Number: 5,197,738

[45] Date of Patent: Mar. 30, 1993

[54] MINIATURE GOLF COURSE

[76] Inventor: David C. Hartman, Sr., 50 Stage Rd., Tuckerton, N.J. 08087

[21] Appl. No.: 849,626

[22] Filed: Mar. 9, 1992

[51] Int. Cl.[5] ..... A63B 67/02

[52] U.S. Cl. ..... 273/176 FA; 273/179 A; 273/176 B; 273/394; 124/3

[58] Field of Search ..... 273/176 FA, 176 FB, 273/176 F, 176 B, 34 A, 179 A, 179 R, 179 B, 179 C, 179 D, 179 E, 394; 124/3

[56] References Cited

U.S. PATENT DOCUMENTS 3,114,555 12/1963 Hurley ..... 273/176 FA
3,467,378 9/1969 English et al. ..... 273/34 A
3,645,536 2/1972 Tierney ..... 273/176 FA X
3,912,275 10/1975 Hagelberg ..... 273/176 FA

*Primary Examiner*—George J. Marlo
*Attorney, Agent, or Firm*—Charles I. Brodsky

[57] ABSTRACT

A miniature golf course wherein an obstacle is positioned between the tee area and the putting cup hole. The obstacle includes a transparent housing containing a solenoid-controlled plunger which is actuated by a switch responsive to a putted golf ball. When actuated, the plunger propels a golf ball upwardly to a retrieving device which directs the golf ball to the putting surface in a predetermined direction relative to the putting cup hole.

3 Claims, 3 Drawing Sheets

MINIATURE GOLF COURSE

FIELD OF THE INVENTION

This invention relates to miniature golf obstacles, in general, and to a new and improved concept for such obstacles, in particular.

BACKGROUND OF THE INVENTION

As is well known and understood, wide varieties of obstacles for miniature golf courses exist. Some may take the form of humps and curves in a putting surface while others may take the form of openings in designed apparatus through which a golfer tries to putt the ball. As is also well known and understood, many such miniature golf holes are pre-fabricated, purchased as a unit from various manufacturers as an operator may desire, and then brought to the site location for installation and play. Around for many years, such miniature golf courses have been analyzed to be generally stagnant in design of the individual hole in play, and innovations of late have been essentially made only in the decor and environs of the course layout—such as jungle motifs, space motifs, etc. But, by and large, the design of the hole continues conservative, if changed at all.

SUMMARY OF THE INVENTION

In considering this, applicant has noted, at the same time, the recent features and modifications that appear annually in the design of pin-ball machines. New arrangements, flippers, ball returns, etc. and layouts are the rule, rather than the exception. In appreciating this, applicant has invented the new design to be described below, and has indicated how the components which produce the result described herein can be tailored into other miniature golf configurations and obstacle formulations.

As will become clear from the following description, the present invention is described in the context of a golf-ball launcher. As disclosed, a player is directed to putt a ball at a specific hole location. If the ball is correctly stroked, its entry into the hole serves to condition a plunger which then drives the ball airborne towards a target—which, in one version of the invention, catches the ball and aims it towards the scoring hole, giving the player a hole-in-one as a score. If the ball were incorrectly putted to begin with, then it enters a second area on the putting surface, from which the player continues to stroke the ball towards the scoring hole, in regular manner of play. As will be appreciated, such ball-launching, angularly and upwardly, can serve to add a new dimension to the game, by enabling a ball to be shot, in effect, to other locations, to other levels, and to bring additional modifications of design into play. As will be seen, such alterations in the manner of play can follow based upon the distance the ball is propelled, and/or upon the height to which it is shot. By enclosing the apparatus in a see-through housing, in addition, provides both a degree of protection for the player as well as for others in the area, and allows for a viewing of how any desired result is attained—including the construction of Rube Goldberg type arrangements where a series of activities follow, all resulting from the proper putting of the ball to begin with, and the ball launching which follows, according to the invention.

As will be seen from the description that follows, the ball launching apparatus of the invention guides a correctly aimed ball to an electromagnetically operated mechanism which is operative to propel the ball through the air towards a target. As will be seen, in a preferred embodiment, the weight of the ball closes a switch to apply a 120 volt alternating current to a solenoid-controlled plunger to deliver the driving force necessary to propel the ball whatever height and/or distance might be desired.

In one specific arrangement, according to the invention, a step-down voltage transformer is coupled with the source of alternating current, and a rectifier is coupled to the output terminals of the transformer. A normally-open relay couples the plunger to the source of alternating current, and a switch is coupled between the rectifier and a control terminal on the relay. The weight of a golf ball is then employed to actuate the switch to close the relay in exerting the driving force necessary to the ball, at an upwards angle upon closure of the relay.

In a particular design of the invention, the rectifier provides full wave rectification to the output voltage developed by the step-down transformer, in the nature of a 12 volt direct current across the switch. With the apparatus enclosed within a miniature golf obstacle, the enclosure is provided with a plurality of input apertures dimensioned to pass a putted golf ball, but with only one of them being arranged to guide the passing golf ball to the switch. As will be noted, once the passing golf ball activates the switch, the solenoid-controlled plunger then drives the ball angularly upward towards a predetermined target.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
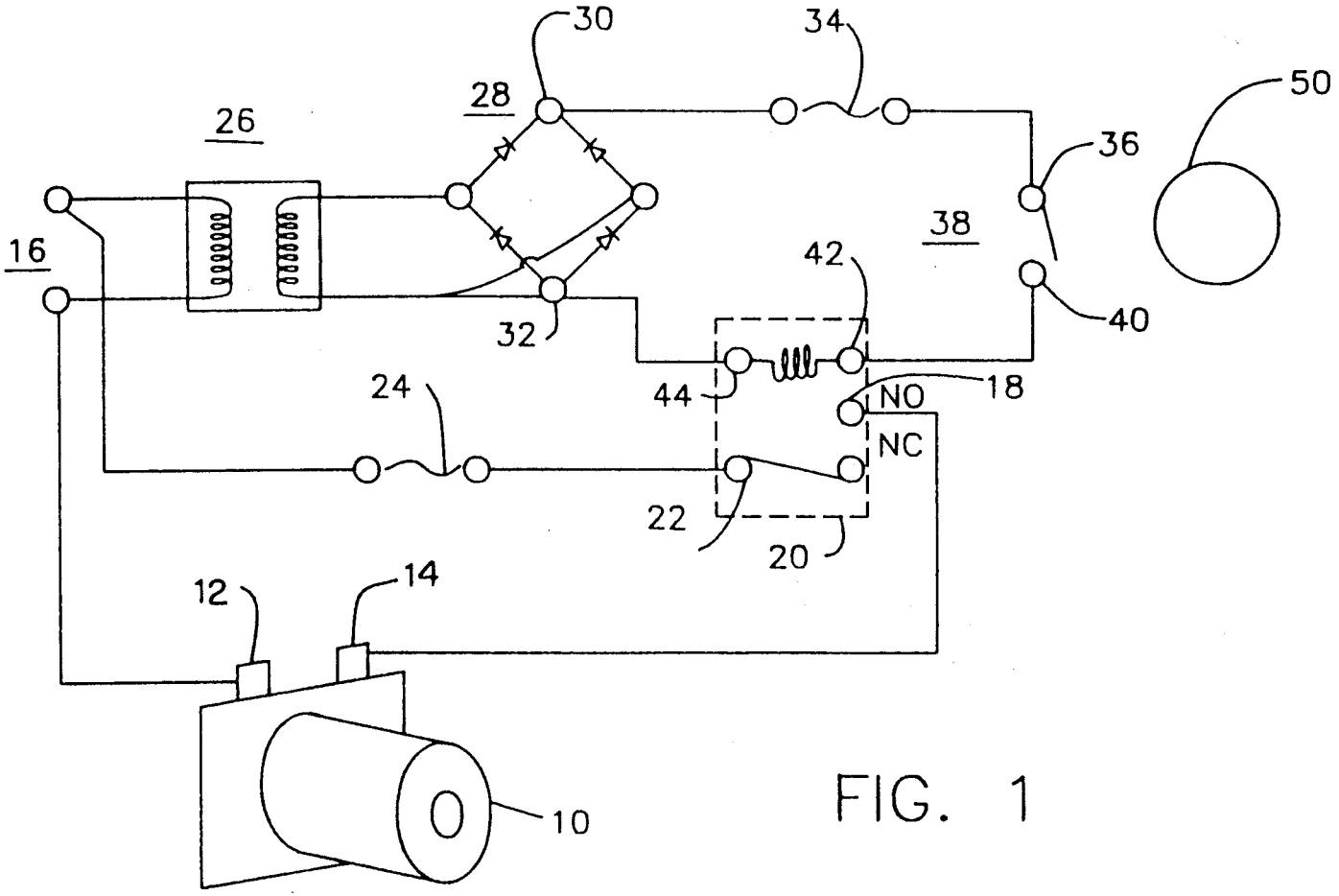
FIG. 1 schematically illustrates a ball launching apparatus for a miniature golf obstacle constructed in accordance with the invention.

Referring to FIG. 1, the solenoid-controlled plunger of the invention is shown at 10, having a pair of terminals 12, 14, respectively coupled to a source of 120 volt alternating current 16 and to the control terminal 18 of a relay 20. As will be appreciated, the relay 18 is normally in an "OPEN" condition. As will also be seen, an input terminal 22 on the relay 20 is coupled by means of a fuse 24 (2 amp when the source of alternating current is 120 volt) to the alternating current source 16 across which a step-down transformer 26 is coupled. In a preferred embodiment of the invention, with a 120 volt AC source 16, a 10:1 step-down is employed, to provide a 12 volt AC output. A full-wave bridge rectifier 28 couples across the output of the transformer 26 so as to provide a 12 DC supply at the terminals 30, 32 of the bridge 28. As will also be seen, terminal 30 of the bridge 28 then couples, by means of a second fuse 34 ($\frac{3}{4}$ amp in the construction using the 120 volt AC source 16), to a terminal 36 of a single-pole, single-throw switch 38. In turn, the second terminal 40 of the switch 38 couples to the switch-coil terminal 42 of the relay 20, the switch-coil terminal 44 of which is connected to the terminal 32 on the bridge 28.

In accordance with the invention, the solenoid-controlled plunger 10 is selected to deliver a driving force necessary to propel a golf ball angularly upward. Exactly what the force would be will be appreciated to depend upon the height and/or distance that the ball is to be propelled. If, when used as part of a miniature golf obstacle to propel a ball from a first level on the hole to a second, higher level, one selection of the solenoid-controlled plunger 10 may be in order. To propel the ball a greater distance, and/or at a greater height, another solenoid-controlled plunger 10 might be required. In either event, the apparatus of FIG. 1 operates when the normally open switch 38 is closed, thereby applying a full 12 volt signal across the relay terminals 42, 44, to close the normally open relay 20 in applying a full 120 volt AC source across the terminals 12, 14 of the plunger 10. Also in accordance with the invention, it is to be understood that the switch 38 is actuated to its "CLOSED" condition upon sensing the weight of a golf ball 50, either the same one which is to be propelled by the plunger 10, or a different golf ball.

Figure 2:
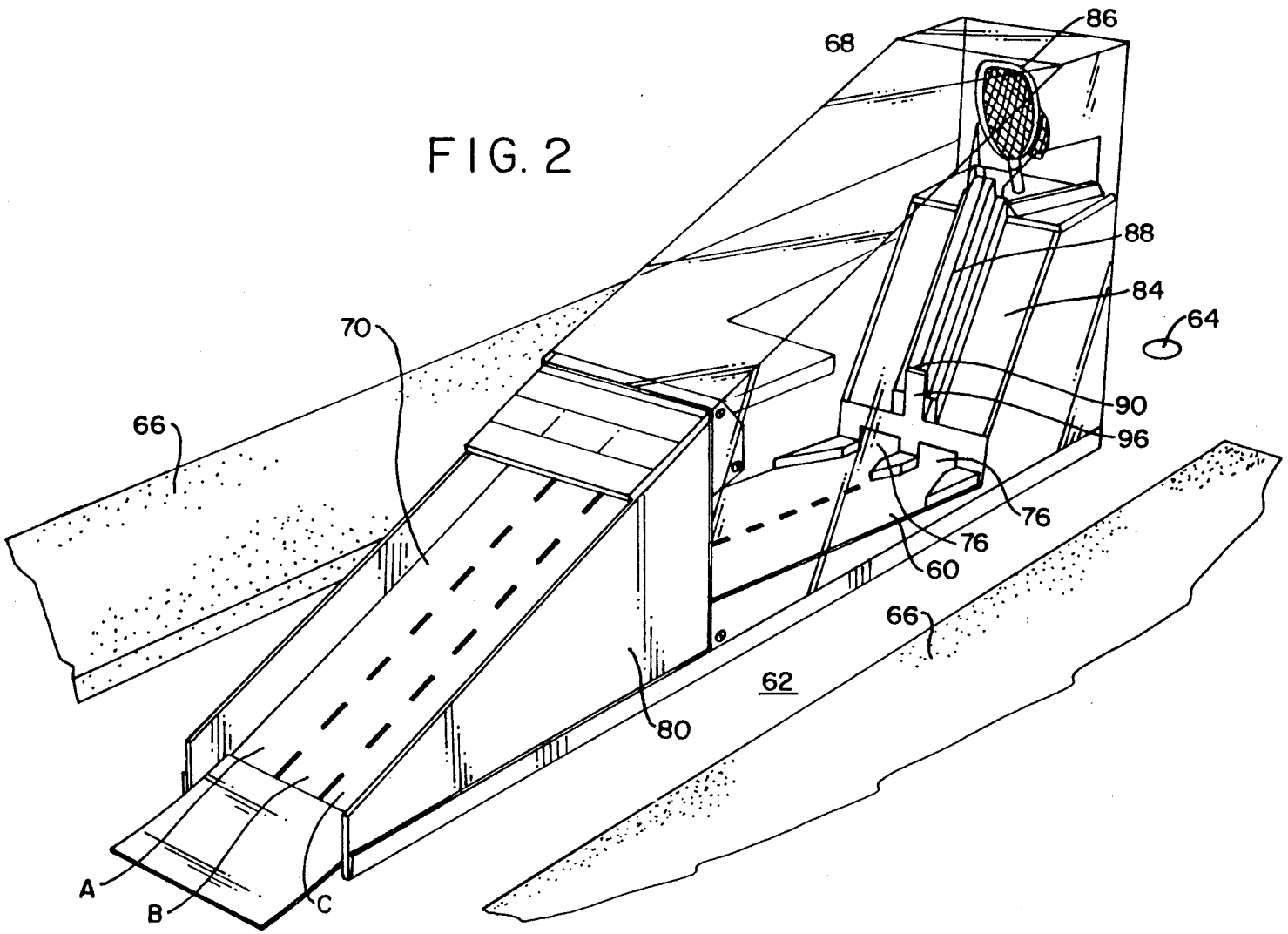
FIGS. 2 and 3 show an enclosure in which the apparatus of FIG. 1 may be housed.
Figure 3:
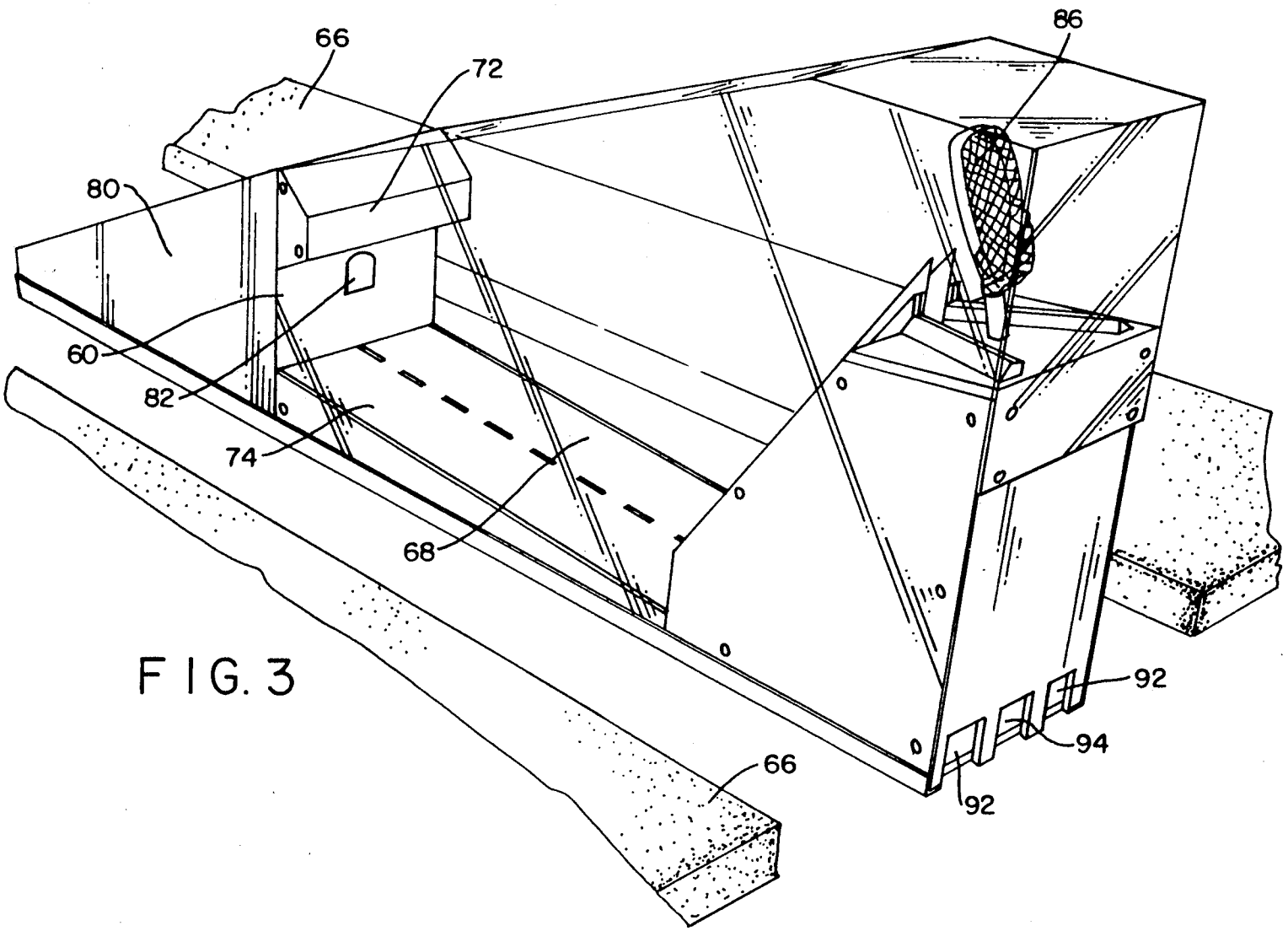

FIGS. 2 and 3 show an enclosure 60 in which the apparatus of FIG. 1 may be housed, and which may be carried to, and placed upon the putting surface of a hole 62 having a scoring hole 64. As will be seen, a player may putt around the enclosure and remain within the boundaries of the hole 62, defined by the border contours 66. As will also be understood from the following description, the configuration of the hole 62 may be however desired—either flat, humped, banked, multi-level, etc. In accordance with the invention, in any case, the enclosure 60 is preferably see-through in the vicinity 68 so that the ball-launch action which follows can be observed.

In accordance with this embodiment of the invention, a player standing at the Tee area of the hole 62 putts the ball up the ramp 70, preferably along the middle lane B of the three marked lanes A, B, C. Obviously, if the ball is not stroked hard enough by the player, it will not make it all the way up the ramp 70, but will roll back down to the Tee area. On the other hand, if the ball is stroked hard enough to negotiate the ramp 70, it will enter one of three areas defined at the end of the lanes A, B, C at the top of the ramp. If putted up the ramp to reach its top at the lanes A or C, the ball enters an area where it merely falls through the overhang 72, to drop onto a downwardly sloped ramp 74 in entering one of two output channels 76 which direct the ball past the enclosure 60 towards the rear of the hole 62; in setting up the enclosure 60 on the hole 62 beforehand, however, such output channels are aligned so that any ball which passes through them will miss the scoring hole 64, and necessitate further putting by the player in trying to score. With the enclosure 60 being of a see-through visibility in the vicinity 68, a player who guides his, or her, ball up the ramp 70, but through the lanes A or C will observe their ball falling from the overhang 72, rolling down the ramp 74 and exiting through the channels 76 rearwardly of the hole 62.

With the apparatus of the present invention, on the other hand, a properly guided ball stroked up the lane B of the ramp 70 is directed not to fall from the overhang 72, however, but is guided by a channel to fall towards the switch 38 included as part of the apparatus (FIG. 1), so as to start the ball propelling action. In this respect, it will be apparent that the apparatus of FIG. 1 is incorporated within that section of the enclosure 60 delineated by the reference numeral 80. Thus, with the weight of the properly guided ball thus closing the switch 38, the solenoid-controlled plunger strikes the ball at an upwards angle, to propel the ball outwardly from the housing area 80 through an opening 82. A second area of the enclosure is shown at 84 where the output channels 76 appear. Also located there is a "target" 86, shown in the nature of a net to catch and downwardly direct the ball propelled through the opening 82. More particularly, the target 86 directs the ball down a guide 88 to its own opening 90 through which it is channeled out the area 84 to similarly exit rearwardly of the hole 62. But, as will be appreciated by those skilled in the art, whereas the output channels 76 at the area 84 guide a ball through the exit ports 92 so as to miss the scoring hole 64, the guide 88 directs the ball captured by the target 86 so as to exit through the port 94 which is in alignment with the scoring hole 64, as established in orienting the enclosure 60 on the hole 62, and between its border contours 66 at the time of installation. Thus, a properly guided ball stroked up the ramp 70 sufficient to enter the opening at the top of the lane B is then propelled by the apparatus of FIG. 1 that distance and height necessary to strike the target 86, where it is caught, and directed down the guide 88 to exit the port 94 directing that ball to the scoring hole 64. A projection arm 96 extends outwardly from the enclosure area 84 at the bottom of the guide 88, so as to "catch" the caught ball falling through the guide 88, so as to direct it out through the exit port 94. As will be apparent, the target 86 may be in the nature of a "Lacrosse-type" net, or any other type of arrangement which operates to catch the propelled ball, so as to deflect it down the guide and out the exit port properly angled to the scoring hole 64. A properly stroked ball, up the ramp 70 through the lane B, can thus result in the player scoring a hole-in-one.

While there has been described what is considered to be a preferred embodiment of the present invention, it will be readily appreciated that modifications can be made by those skilled in the art without departing from the scope of the teachings herein. For example, different type enclosures can be designed other than as set forth to direct a properly putted ball towards a ball launcher, and different types of "catch" constructions can be employed to ultimately deliver the ball to the scoring hole, or to any other level or area that might be designed into the miniature golf hole, as desired. Similarly, different types of ball launchers can be designed, as with different voltages being applied, both alternating current and direct current—as long as the end result is kept—namely, being able to propel a golf ball angularly upwards, the distance and height required to reach the target area where further action comes into play. Thus, and as an illustration, one skilled in the art might merely utilize the ball launcher to propel a golf ball to a different level, at a different area of the hole, without the need for a catch-target to begin with, just to propel it to a different putting surface as an illustration. As will be understood, however, such a modification would still entail the use of the solenoid-controlled plunger of the invention, in which the weight of the ball actuates the relay so as to apply the needed voltage which operates the solenoid-controlled plunger in providing its propelling force. For at least such reasons, therefore, resort should be had to the claims appended hereto for a true understanding of the scope of the invention.

I claim:

1. A miniature golf course comprising at least one elongated surface including a tee area and a scoring hole spaced a predetermined distance therefrom, an obstacle positioned between said tee area and scoring hole, said obstacle including a solenoid-controlled plunger, a golf ball responsive switch means for causing said plunger to propel a golf ball upwardly a predetermined height above said surface, said obstacle including means for forming a putting path to said switch means, and means for retrieving said upwardly propelled golf ball and directing same to said surface in a predetermined direction relative said scoring hole.

2. The miniature golf course of claim 1 wherein said obstacle is contained within an enclosure.

3. The miniature golf course of claim 2 wherein said enclosure is transparent so that said upwardly propelled golf ball may be viewed by a golfer.

* * * * *